United States Patent [19]

Bestenreiner et al.

[11] 4,013,356

[45] Mar. 22, 1977

[54] APPARATUS FOR DEVELOPING ELECTROSTATIC IMAGES WITH LIQUID TONER

[75] Inventors: Friedrich Bestenreiner, Grunwald; Dieter Giglberger, Unterhaching; Gert Weidkuhn, Freiburg, all of Germany

[73] Assignee: AGFA-Gevaert, A.G., Leverkusen, Germany

[22] Filed: Apr. 10, 1975

[21] Appl. No.: 566,685

[30] Foreign Application Priority Data

Apr. 11, 1974 Germany ..... 2417721

[52] U.S. Cl. ..... 355/10; 118/DIG. 23; 354/317; 427/15

[51] Int. Cl.[2] ..... G03G 15/10

[58] Field of Search ..... 355/10; 96/1 LY; 427/15–17; 118/DIG. 23; 354/317, 324

[56] References Cited

UNITED STATES PATENTS

| | | | |
|---|---|---|---|
| 2,587,350 | 2/1952 | Maiwald | 354/317 |
| 3,081,687 | 3/1963 | Takats | 354/317 |
| 3,371,651 | 3/1968 | Johnson et al. | 427/15 X |
| 3,758,204 | 9/1973 | Mochizuki | 118/DIG. 23 |
| 3,791,345 | 2/1974 | McCutcheon | 118/DIG. 23 |
| 3,901,188 | 8/1975 | Eberlein | 118/DIG. 23 |
| 3,943,268 | 3/1976 | Sato | 355/10 |

*Primary Examiner*—R. L. Moses
*Attorney, Agent, or Firm*—Michael J. Striker

[57] ABSTRACT

An electrophotographic copying machine wherein electrostatic images at the periphery of a rotary cylindrical printing base are transported below a grounded developing electrode having in its concave underside a series of shallow grooves each receiving fresh liquid toner through one or more inclined supply ports at the upstream end and each discharging spent liquid toner into one or more inclined evacuating ports at the downstream end thereof. The flow of liquid toner in the grooves is laminar, and the speed of liquid flow in the grooves equals or approximates the speed of movement of the printing base relative to the electrode. The electrode carries several distancing rolls which extend beyond its underside and the electrode is biased by springs so that the distancing rolls bear against and roll along the periphery of the printing base.

9 Claims, 1 Drawing Figure

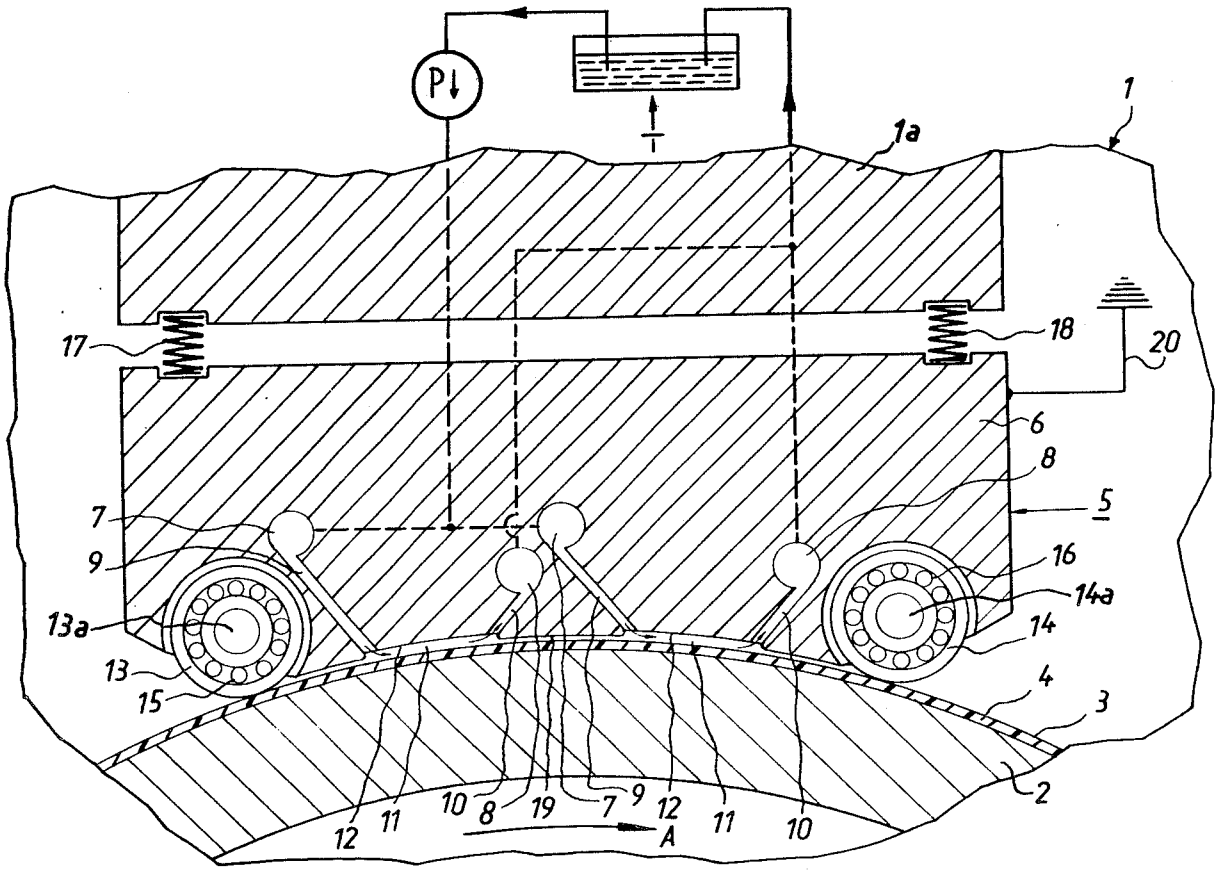
1
1a
20
18
17
5
6
8
16
14a
14
4
3
2
10
11
12
A
9
7
19
8
10
11
12
15
13
13a
7
9
P

APPARATUS FOR DEVELOPING ELECTROSTATIC IMAGES WITH LIQUID TONER

BACKGROUND OF THE INVENTION

The present invention relates to electrophotographic copying machines in general, and more particularly to improvements in copying machines wherein electrostatic images at the active face of a mobile printing base are developed with a liquid toner, i.e., with a developing agent wherein minute toner particles are distributed in a liquid suspension medium. Still more particularly, the invention relates to improvements in liquid toner developing apparatus wherein the active face of the printing base moves along and is substantially parallel to one side of a developing electrode while the electrostatic image on the active face is being contacted with liquid toner. Still more particularly, the invention relates to developing apparatus of the just outlined character wherein the developing electrode is preferably impermeable to liquid toner and the liquid toner fills the space between the electrode and the active face of the printing base.

SUMMARY OF THE INVENTION

An object of the invention is to provide a liquid toner developing apparatus which is capable of completing the development of electrostatic images within intervals which are shorter than in heretofore known developing apparatus.

Another object of the invention is to provide a developing apparatus which is capable of applying liquid toner to electrostatic images on a mobile printing base in such a way that the developed images are not blurred and do not exhibit the so-called "edge" effect.

A further object of the invention is to provide a liquid toner developing apparatus which occupies a minimum of space and wherein the developing electrode is maintained at a fixed distance from the active face of the mobile printing base in a novel and improved way.

An additional object of the invention is to provide a liquid toner developing apparatus which can be designed for use in electrophotographic copying machines wherein the active face of the printing base is flat or arcuate and which insures that the length of the region of contact between the electrostatic image and liquid toner (as considered in the direction of movement of the printing base relative to the electrode) is shorter than in heretofore known developing apparatus.

The invention is embodied in an electrophotographic copying machine which comprises a printing base (e.g., a hollow cylinder) having an active face (this active face may constitute the peripheral or external surface of the hollow cylinder) for electrostatic images, a drum-shaped or otherwise configurated conveyor for moving the active face along a predetermined path and in a predetermined direction, and a novel developing apparatus which comprises a developing electrode adjacent to and having a side substantially parallel to the predetermined path whereby such side of the electrode defines with the active face at least one narrow groove or clearance. The developing apparatus further comprises means for circulating liquid toner in the clearance, preferably in such a way that the flow of liquid toner is laminar, that the liquid toner flows in the predetermined direction, and that the speed of liquid toner flow in the clearance or clearances equals or approximates the speed of movement of the active face. The circulating means has liquid supplying port means at one end and liquid evacuating port means at the other end of each clearance, as considered in the direction of movement of the printing base. The port means are configurated and arranged in such a way that the directions in which liquid toner enters into and is evacuated from the respective clearance or clearances make an oblique angle with the direction of movement of the printing base.

The novel features which are considered as characteristic of the invention are set forth in particular in the appended claims. The improved developing apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE is a fragmentary sectional view of an electrophotographic copying machine which embodies the improved liquid toner developing apparatus.

DESCRIPTION OF THE PREFERRED EMBODIMENTS

The drawing shows a portion of an electrophotographic copying machine which embodies the improved developing apparatus. The copying machine comprises a frame or support 1 for a drum-shaped conveyor 2 which can be driven to rotate in the direction indicated by arrow A. The periphery of the conveyor 2 is surrounded by a hollow cylindrical printing base 4 having an active face or outer surface 3 which carries the electrostatic image.

The developing apparatus 5 comprises a housing 6 which is mounted in the frame 1 of the copying machine and is shown as being located at a level above the conveyor 2. However, it is equally within the purview of the invention to mount the developing apparatus 5 below or laterally of the conveyor 2. Such versatility of the apparatus 5 (as concerns its positioning with respect to the printing base 4) is attributable to the fact that the surplus of liquid toner cannot escape when the copying machine is in use. The reasons for the absence of leakage of surplus liquid will be understood as the description proceeds.

The housing 6 of the developing apparatus 5 is formed with several liquid toner circulating means each of which includes a channel or bore 7, a channel or bore 8, at least one supply orifice or port 9 which extends from the respective channel 7 to the underside 19 of the housing 6, and at least one evacuating orifice or port 10 which extends from the underside 19 to the respective channel 8. The channels 7 and their orifices 9 supply fresh liquid toner into the space between the active face 3 and the underside 19 of the housing 6, whereas the channels 8 and their orifices 10 serve for evacuation of spent liquid toner from such space.

Each of the aforedescribed liquid toner circulating means is associated with a relatively shallow clearance or groove 11 which is machined into the underside 19 of the housing 6 and has a bottom surface 12 along which liquid toner flows from the supply orifice 9 to the respective evacuating orifice 10. The bottom surfaces 12 are disposed opposite the active face 3 and the grooves 11 are disposed one after the other, as considered in the direction of rotation of the printing base 4 (arrow A). The orifices 9 and 10 make oblique angles with the direction indicated by arrow A and are machined into the housing 6 in such a way that the outlet of each orifice 9 communicates with the upstream end and the inlet of each orifice 10 communicates with the downstream end of the respective groove 11.

The distance between the bottom surfaces 12 of the grooves 11 and the active face 3 of the printing base 4 is very small and the overall number $n$ of grooves 11 in the housing 6 satisfies the equation $$n = \frac{\ln \frac{\delta_n}{\delta_0}}{\ln \left(1 - \frac{dcq}{m\delta_0}\right)}$$

wherein $n$ is the density of the charge of electrostatic image on the active face 3 of the printing base 4 (such charge is that which has remained subsequent to development), $\delta_o$ is the initial or original density of the charge of electrostatic image on the printing base 4, $m$ is the average mass of toner particles in the liquid suspension medium, and $q$ is the average charge of toner particles.

If the conveyor 2 is driven at a speed $v$, the number of grooves 11 is $n$, and the thickness of the image layer is $d_s$, the density of charge of the electrostatic image can be reduced from $\delta_o$ to $\delta_n$ within the shortest interval of time when the average charge of toner particles in the liquid suspension medium equals $q$. The distance $l$ between the outlet of an orifice 9 and the inlet of the associated orifice 10 can be determined as follows:

$$l = \frac{v\epsilon_o}{\beta\epsilon o}\left(\epsilon_s \frac{d^2}{d_s} + \epsilon_e d\right)$$

wherein $\epsilon_s$ is the dielectric constant of the printing base 4, $\epsilon_e$ is the dielectric constant of the liquid toner, $\epsilon_o$ is the absolute dielectric constant, and $\beta$ is the average electrophoretic mobility of a toner particle in the liquid suspension medium.

As stated above, the distance $d$ between the housing 6 and the printing base 4 is preferably very small. The aforedescribed selection of each distance $l$ and of the number ($n$) of pairs of orifices or ports 9, 10 insures that the electrostatic image on the base 4 is contacted by a sufficient quantity of liquid toner within an extremely short interval of time and that the development is uniform along the entire active face 3. Also, the region of contact between the printing base 4 and liquid toner (as considered in the direction of arrow A) is surprisingly short.

By dividing the region of contact between liquid developer and the printing base into several ($n$) sections, the distance $l$ between two cooperating ports 9, 10 can be reduced proportionally with the square of the distance $d$.

The housing 6 of the developing apparatus 5 carries shafts 13*a*, 14*a* for roller-shaped distancing members 13, 14 which respectively rotate on antifriction ball or roller bearings 15, 16 and extend slightly beyond the underside 19. The peripheral surfaces of the distancing members 13, 14 are biased against the active face 3 by helical springs 17, 18 which react against a portion 1*a* of the frame 1 and bear against that side of the housing 6 which faces away from the active face 3. The distancing members 13, 14 and the springs 17, 18 insure that the distance between the underside 19 of the housing 6 and the active face 3 remains constant in all angular positions of the conveyor 2. The curvature of the underside 19 may but need not match the curvature of the periphery of the printing base 4, i.e., the underside 19 may but need not be parallel to the adjacent portion of the path of movement of the active face 3. The housing 6 is impermeable to liquids and constitutes a developing electrode which is grounded, as at 20.

The operation is as follows:

An electrostatic image which has been applied to the printing base 4 ahead of the housing or electrode 6 is transported along the underside 19 of the housing in response to rotation of the conveyor 2 in the direction indicated by arrow A. The image on the active face 3 reaches the developing station after advancing beyond the first distancing member 13, i.e., when it begins to move along the first clearance or groove 11. A variable-delivery pump P or the like of the circulating means causes fresh liquid toner to flow from a vessel T into the channels 7 so that such liquid toner enters the grooves 11 by way of the respective supply orifices 9 and leaves the grooves by way of the respective evacuating orifices 10 to thereupon enter the respective channels 8 and be returned into the vessel T. The ratio of the speed $v$ of the conveyor 2 to the speed at which the liquid toner flows into and from the grooves 11 is selected in such a way that the flow of liquid in the grooves 11 is substantially laminar. This insures uniform and accurately reproducible development of the electrostatic image. The laminar flow of liquid toner is also promoted by appropriate selection of oblique angles which the directions of liquid flow in the orifices 9, 10 make with the direction indicated by arrow A. The likelihood of blurring of the developed image is reduced if the difference between the speed $v$ and the speed of liquid toner flow in the grooves is small or equals zero.

The orifices 10 evacuate all or practically all of the liquid toner which is supplied by the associated orifices 9. Therefore, liquid toner cannot escape from the grooves or clearance 11 by flowing along the ungrooved portions of the underside 19.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. In an electrophotographic copying machine, the combination of a printing base which has an active face for supporting electrostatic images and is movable in a predetermined direction to advance said active face along a predetermined path, with a developing apparatus which comprises electrode means adjacent to and having a side substantially parallel to said path so that said electrode means and said active face define narrow clearances, means for circulating liquid toner in said clearances having liquid supplying port means at one end and liquid evacuating port means at the other end of each of said clearances, as considered in said direction, arranged to supply and evacuate liquid toner in direction making oblique angles with said predetermined direction, wherein the number of clearances is $n$ and $$n = \frac{\ln \frac{\delta_n}{\delta_0}}{\ln \left(1 - \frac{dcq}{m\delta_0}\right)}$$

wherein, $\delta 0$ is the initial density of charge of an image on said printing base, $\delta n$ is the remaining density of charge of a developed image, $d$ is the distance between said side and said active face, $q$ is the average charge of toner particles, and $m$ is the average mass of toner particles.

2. The combination of claim 1, wherein $$l = \frac{v\epsilon_o}{\beta\delta o}\left(\epsilon_s \frac{d^2}{d_s} + \epsilon_e d\right)$$

in which $l$ is a distance between the port means communicating with a clearance, $v$ is the speed of movement of said printing base relative to said electrode means, $d_s$ is the thickness of the image layer on said printing base, $\epsilon_s$ is the dielectric constant of the image, $\epsilon_e$ is the dielectric constant of liquid toner, $\epsilon_o$ is the absolute dielectric constant, and $\beta$ is the average electrophoretic mobility of toner particles in the suspension medium of liquid toner.

3. The combination of claim 1, wherein said electrode means is impermeable to liquids.

4. The combination of claim 1, wherein said angles and the speeds of admission and evacuation of liquid toner via said port means are such that the flow of liquid toner in said clearance is at least substantially laminar.

5. The combination of claim 1, wherein the speed of liquid toner flow in said clearance at least approximates the speed of movement of said printing base relative to said electrode means.

6. The combination of claim 1, wherein said port means are orifices provided in said electrode means.

7. The combination of claim 5, wherein said circulating means further comprises liquid supplying and evacuating channels provided in said electrode means and communicating with the respective orifices.

8. The combination of claim 1, wherein said printing base is a rotary cylinder and said active face is the peripheral surface of said cylinder, said side of said electrode means having a curvature matching that of said peripheral surface, said one end of said clearance being located ahead of said other end, as considered in said predetermined direction, so that the liquid toner flows in said clearance in said predetermined direction.

9. In an electrophotographic copying machine, the combination of a printing base which has an active face for supporting electrostatic images and is movable in a predetermined direction to advance said active face along a predetermined path, with a developing apparatus which comprises electrode means adjacent to and having a side substantially parallel to said path so that said electrode means and said printing base define at least one narrow clearance, a support for said printing base and said electrode means, said electrode means being movable in said support transversely of said path and further comprising distancing members mounted on said electrode means and extending beyond said side thereof and means for biasing said distancing members against said active face so that the distance between said active face and said side of said electrode means is substantially constant, and means for circulating liquid toner in said clearance, said circulating means having liquid supplying port means at one end and liquid evacuating port means at the other end of said clearance, as considered in said direction, said port means being arranged to supply and evacuate liquid toner in direction making oblique angles with said predetermined direction.

* * * * *